US009957944B2

(12) United States Patent
Nakayama

(10) Patent No.: US 9,957,944 B2
(45) Date of Patent: May 1, 2018

(54) IGNITION APPARATUS FOR INTERNAL COMBUSTION ENGINE

(71) Applicant: DENSO CORPORATION, Kariya, Aichi-pref. (JP)

(72) Inventor: Satoru Nakayama, Kariya (JP)

(73) Assignee: DENSO CORPORATION, Kariya (JP)

( * ) Notice: Subject to any disclaimer, the term of this patent is extended or adjusted under 35 U.S.C. 154(b) by 39 days.

(21) Appl. No.: 15/302,550

(22) PCT Filed: Apr. 7, 2015

(86) PCT No.: PCT/JP2015/060893
§ 371 (c)(1),
(2) Date: Oct. 7, 2016

(87) PCT Pub. No.: WO2015/156298
PCT Pub. Date: Oct. 15, 2015

(65) Prior Publication Data

US 2017/0037826 A1 Feb. 9, 2017

(30) Foreign Application Priority Data

Apr. 10, 2014 (JP) ..... 2014-080764

(51) Int. Cl.
*F02P 3/05* (2006.01)
*F02P 17/12* (2006.01)

(52) U.S. Cl.
CPC ..... *F02P 3/05* (2013.01); *F02P 3/053* (2013.01); *F02P 17/12* (2013.01)

(58) Field of Classification Search
CPC ..... F02P 3/05; F02P 3/053; F02P 17/12
See application file for complete search history.

(56) References Cited

U.S. PATENT DOCUMENTS

2013/0192570 A1* 8/2013 Kajita ..... F02P 15/00 123/596
2015/0152832 A1* 6/2015 Desai ..... F02P 9/002 123/625

FOREIGN PATENT DOCUMENTS

JP 61-49505 10/1986
JP 08068372 A * 3/1996
JP 2003-074452 3/2003
JP 2008-88947 4/2008
(Continued)

*Primary Examiner* — Erick Solis
*Assistant Examiner* — Anthony L Bacon
(74) *Attorney, Agent, or Firm* — Nixon & Vanderhye PC

(57) ABSTRACT

An ignition apparatus includes a blow-off determining unit 5*b*. The blow-off determining unit 5*b* determines, when the value ΔI2 of the time derivative of a secondary electric current exceeds a predetermined threshold value Z during a determination period, that blow-off has occurred; the determination period is a predetermined time period ΔT from the start of a spark discharge by a main ignition circuit 3. Further, when it is determined that blow-off has occurred during a main ignition (full-transistor ignition), it is controlled to perform a continuing spark discharge after the main ignition in a next cycle. Moreover, a secondary electric current command value in performing the continuing spark discharge is set to an electric current value that is obtained by adding a predetermined electric current value α to the secondary electric current value I2x immediately before the occurrence of blow-off. Consequently, in the next cycle, it is possible to reliably prevent blow-off, thereby reliably preventing misfire.

8 Claims, 5 Drawing Sheets

(56) References Cited

FOREIGN PATENT DOCUMENTS

| | | |
|---|---|---|
| JP | 4938404 | 5/2012 |
| WO | WO 2009/116303 | 9/2009 |

* cited by examiner

IGNITION APPARATUS FOR INTERNAL COMBUSTION ENGINE

This application is the U.S. national phase of International Application No. PCT/JP2015/060893 filed 7 Apr. 2015, which designated the U.S. and claims priority to JP Patent Application No. 2014-080764 filed 10 Apr. 2014, the entire contents of each of which are hereby incorporated by reference.

TECHNICAL FIELD

The present invention relates to ignition apparatuses for use in internal combustion engines, and more particularly to techniques for continuing a spark discharge.

BACKGROUND ART

As a technique for reducing the burden of an ignition plug, suppressing unnecessary electric power consumption and continuing a spark discharge, the present applicant has devised an energy input circuit (not a publicly known art). The energy input circuit inputs electrical energy, after the start of an initial spark discharge (to be referred to as main ignition) by a well-known ignition circuit, to a battery voltage supply line from a low-voltage side of a primary coil before the main ignition is blown off; with the electrical energy input, the energy input circuit continuously applies electric current in the same direction to a secondary coil (DC secondary electric current), thereby continuing the spark discharge caused by the main ignition for an arbitrary time period (hereinafter, discharge continuation period). In addition, hereinafter, the spark discharge continued by the energy input circuit (the spark discharge following the main ignition) will be referred to as continuing spark discharge.

The energy input circuit controls, by controlling a primary electric current (input energy) in the discharge continuation period, the secondary electric current to sustain the spark discharge. By controlling the secondary electric current in the continuing spark discharge, it is possible to reduce the burden of the ignition plug due to the repetition of blow-off of the spark discharge and re-discharge, suppress unnecessary electric power consumption and continue the spark discharge.

Moreover, since the secondary electric current is applied in the same direction in the continuing spark discharge following the main ignition, it is difficult for the spark discharge to be interrupted in the continuing spark discharge following the main ignition. Therefore, with employment of the continuing spark discharge by the energy input, it is possible to prevent blow-off of the spark discharge even in a lean-burn operating condition where a rotational flow is created in the cylinder.

Next, for the purpose of assisting the understanding of the present invention, a typical example of the energy input circuit (as described above, not a publicly known art), to which the present invention is not applied, will be described based on FIGS. 6-8. In addition, in FIG. 6, functional components identical to those in embodiments which will be described later are given the same reference signs as in the embodiments.

An ignition apparatus as shown in FIG. 6 includes a main ignition circuit 3 that causes the main ignition in an ignition plug 1 by a full-transistor operation (on/off operation of an ignition switching means 13) and the energy input circuit 4 that performs the continuing spark discharge following the main ignition.

The energy input circuit 4 is configured with a boosting circuit 18 that boosts the voltage of an in-vehicle battery 11 (DC power source), an energy input switching means 27 for controlling the electrical energy inputted to the low-voltage side of the primary coil 7, and an energy input driver circuit 28 that controls the on/off operation of the energy input switching means 27.

FIG. 7 shows time charts illustrating the operation of the ignition apparatus in causing the main ignition. "IGT" is a high/low signal of an ignition signal IGT. "IGW" is a high/low signal of a discharge continuation signal IGW. "I2" is the secondary electric current (value of the electric current flowing in the secondary coil).

The main ignition circuit 3 operates based on the ignition signal IGT provided by an ECU 5 (abbreviation of Engine Control Unit). Upon the ignition signal IGT being switched from low to high, the primary coil 7 of the ignition coil 2 is energized. Then, when the ignition signal IGT is switched from high to low and thus the energization of the primary coil 7 is interrupted, a high voltage is generated in the secondary coil 8 of the ignition coil 2, starting the main ignition in the ignition plug.

After the start of the main ignition in the ignition plug 1, the secondary electric current attenuates substantially in the shape of a sawtooth wave (see FIG. 7). In addition, in the time chart of the secondary electric current, the electric current value increases in the direction toward the negative side (downward in the figure).

FIG. 8 shows time charts illustrating the operation of the ignition apparatus in performing the continuing spark discharge after the main ignition.

The energy input circuit 4 operates based on the discharge continuation signal IGW and a secondary electric current command signal IGA provided by the ECU 5; the secondary electric current command signal IGA indicates a secondary electric current command value I2a.

After the main ignition, for inputting energy to the secondary coil 8 before the secondary electric current drops to a "predetermined lower limit electric current value" (electric current value for sustaining the spark discharge) and thereby sustaining the spark discharge, the ECU 5 outputs both the discharge continuation signal IGW and the secondary electric current command signal IGA to the energy input circuit 4.

Upon the discharge continuation signal IGW being switched from low to high, the input of electrical energy from the negative side (low-voltage side) of the primary coil 7 to the positive side (high-voltage side) is started. Specifically, during a time period in which IGW is high, by on/off controlling the energy input switching means 27, the secondary electric current is controlled so as to be kept at the secondary electric current command value I2a (see FIG. 8).

Problematic Issue

With employment of the continuing spark discharge by the energy input, it becomes difficult for blow-off of a spark discharge to occur even in a lean burn operating condition where a rotational flow is created in the cylinder. Nevertheless, there is still a risk of blow-off occurring during the continuing spark discharge.

Moreover, even in the ignition apparatus that is capable of performing the continuing spark discharge by the energy input, there are cases where only the main ignition is performed in an operating condition in which it is relatively difficult for blow-off to occur. However, even in a region which is set as the operating condition where it is difficult for blow-off to occur, there is still a risk of blow-off occurring during the main ignition due to differences between individual engines, variation among cylinders and age deterioration.

Therefore, even in the ignition apparatus that is capable of performing the continuing spark discharge by the energy input, it is still necessary to accurately determine blow-off and take measures to prevent misfire.

In addition, as a technique for preventing blow-off in an ignition apparatus, there is disclosed in Patent Document 1 a technique of switching from a lean operation to a stoichiometric operation when it is impossible to secure a discharge time longer than or equal to a predetermined time. However, even in the stoichiometric operation, there are still cases where it is impossible to secure the discharge time due to differences between individual engines, variation among cylinders and age deterioration. Therefore, even if switched to the stoichiometric operation, there is still a risk that blow-off may occur, thereby resulting in misfire.

Moreover, in Patent Document 2, there is disclosed detection of blow-off. However, according to the technique of Patent Document 2, a discharge is inhibited upon detection of blow-off. Therefore, there is a risk of resulting in misfire.

PRIOR ART LITERATURE

Patent Literature

[PATENT DOCUMENT 1] Japanese Patent No. JP4938404B2

[PATENT DOCUMENT 2] Japanese Patent Application Publication No. JP2013100811A

SUMMARY OF THE INVENTION

Problems to be Solved by the Invention

The present invention has been made in view of the above problems. An object of the present invention is to accurately determine blow-off and reliably prevent misfire due to blow-off in an ignition apparatus for an internal combustion engine which is capable of performing a continuing spark discharge by an energy input.

Means for Solving the Problems

An ignition apparatus for an internal combustion engine according to the present invention includes a main ignition circuit, an energy input circuit and a blow-off determining unit.

The main ignition circuit performs energization control of a primary coil of an ignition coil, thereby causing a spark discharge in an ignition plug.

The energy input circuit inputs electrical energy to the primary coil during the spark discharge started by operation of the main ignition circuit, thereby applying a secondary electric current in the same direction to a secondary coil of the ignition coil. The energy input circuit also keeps the secondary electric current at a secondary electric current command value, thereby continuing the spark discharge started by operation of the main ignition circuit.

The blow-off determining unit determines, when the value $\Delta I2$ of the time derivative of the secondary electric current exceeds a predetermined threshold value Z during a determination period, that blow-off has occurred; the determination period is a predetermined time period $\Delta T$ from the start of a spark discharge by the main ignition circuit.

According to the present invention, it is possible to accurately determine blow-off with the value $\Delta I2$ of the time derivative of the secondary electric current.

Hence, it is also possible to take various measures to prevent misfire (for example, measures recited in Claims 3-8) when it is determined that blow-off has occurred.

Accordingly, it is possible to accurately determine blow-off and reliably prevent misfire due to blow-off in an ignition apparatus for an internal combustion engine which is capable of performing a continuing spark discharge by an energy input.

EMBODIMENTS FOR CARRYING OUT THE INVENTION

Figure 1:
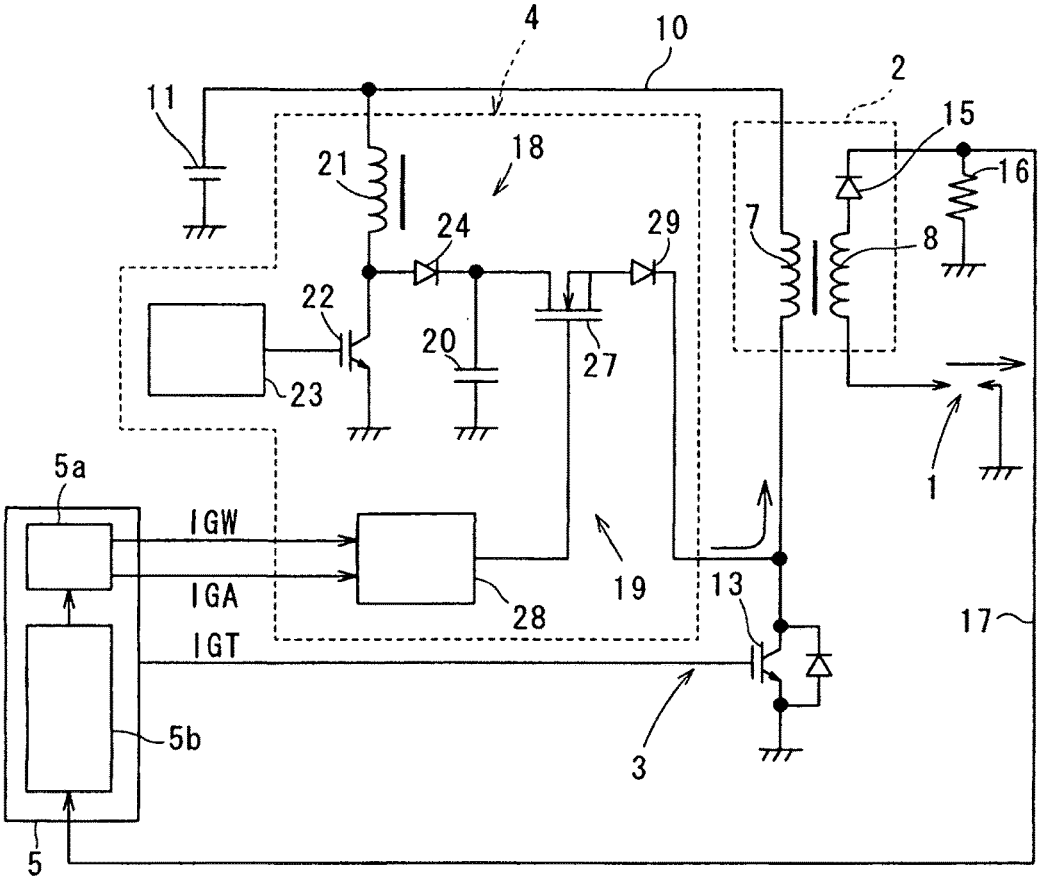
FIG. 1 is a schematic configuration diagram of an ignition apparatus for an internal combustion engine (a first embodiment).

Hereinafter, embodiments of the present invention will be described with reference to the drawings.

In addition, each of the following embodiments discloses one specific example, and it goes without saying that the present invention is not limited to the following embodiments.

First Embodiment

A first embodiment will be described with reference to FIGS. 1-4.

An ignition apparatus in the first embodiment is designed to be mounted to a spark ignition engine for vehicle driving and ignite an air-fuel mixture in a combustion chamber at predetermined ignition timing. In addition, an example of the engine is a direct injection engine which uses gasoline as fuel and is capable of lean burn. The engine includes a rotational flow control means for creating a rotational flow (tumble flow or swirl flow) of the air-fuel mixture in the cylinder.

The ignition apparatus in the first embodiment is of a DI (Direct Ignition) type which uses a corresponding ignition coil 2 for an ignition plug 1 of each cylinder.

The ignition apparatus includes the ignition plug 1, the ignition coil 2, a main ignition circuit 3, an energy input circuit 4 and an ECU 5.

The main ignition circuit 3 and the energy input circuit 4 control energization of a primary coil 7 of the ignition coil 2 based on command signals provided by the ECU 5. Further, by controlling energization of the primary coil 7, these circuits 3 and 4 also control electrical energy generated in a secondary coil 8 of the ignition coil 2, thereby controlling a spark discharge of the ignition plug 1.

In addition, the ECU 5 generates and outputs an ignition signal IGT, a discharge continuation signal IGW and a secondary electric current command signal IGA according to engine parameters (warm-up state, engine rotational speed, engine load and the like) acquired from various sensors and the engine control state (the presence or absence of lean burn, the degree of rotational flow and the like).

That is, the ECU 5 includes a main ignition commanding unit (not shown) that generates and sends to the main ignition circuit 3 the ignition signal IGT and an energy input commanding unit 5*a* that generates and sends to the energy input circuit 4 both the discharge continuation signal IGW and the secondary electric current command signal IGA.

The ignition plug 1 is of a well-known type. The ignition plug 1 includes a center electrode that is connected with one end of the secondary coil 8 of the ignition coil 2 via an output terminal and an outer electrode that is earth grounded via a cylinder head of the engine or the like. The spark discharge is caused between the center electrode and the outer electrode by the electrical energy generated in the secondary coil 8. An ignition plug 1 is mounted to each cylinder.

The ignition coil 2 includes the primary coil 7 and the secondary coil 8 that has a greater number of turns than the primary coil 7.

One end of the primary coil 7 is connected with a positive terminal of the ignition coil 2. The positive terminal is connected to a battery voltage supply line 10 (a line receiving the supply of electric power from a positive electrode of an in-vehicle battery 11).

The other end of the primary coil 7 is connected with a ground-side terminal of the ignition coil 2. The ground-side terminal is earth grounded via an ignition switching means 13 (power transistor, MOS transistor or the like) of the main ignition circuit 3.

One end of the secondary coil 8 is connected with the output terminal as described above. The output terminal is connected with the center electrode of the ignition plug 1.

The other end of the secondary coil 8 is earth grounded via a first diode 15 and an electric current detection resistor 16. The first diode 15 limits the flow direction of electric current flowing in the secondary coil 8 to one direction. The electric current detection resistor 16 functions as detection means for detecting the secondary electric current.

In the present embodiment, the electric current detection resistor 16 is connected with the ECU 5 via a detection line 17, so that a detection value of the secondary electric current is inputted to the ECU 5.

The main ignition circuit 3 is a circuit which performs energization control of the primary coil 7 of the ignition coil 2, thereby causing a spark discharge in the ignition plug 1.

The main ignition circuit 3 applies the voltage of the in-vehicle battery 11 (battery voltage) to the primary coil 7 for a time period in which the ignition signal IGT is provided. Specifically, the main ignition circuit 3 includes the ignition switching means 13 (power transistor or the like) for switching on/off the energization state of the primary coil 7. Upon provision of the ignition signal IGT, the ignition switching means 13 is turned on, thereby applying the battery voltage to the primary coil 7.

The ignition signal IGT is a signal which commands a time period in which magnetic energy is to be stored in the primary coil 7 in the main ignition circuit 3 (energy storage time) and a discharge start timing.

The energy input circuit 4 is a circuit which inputs electrical energy to the primary coil 7 during a spark discharge started by operation of the main ignition circuit 3, thereby applying the secondary electric current in the same direction to the secondary coil 8 to continue the spark discharge started by operation of the main ignition circuit 3.

The energy input circuit 4 is configured with a boosting circuit 18 and an input energy control means 19.

The boosting circuit 18 boosts, during the time period for which the ignition signal IGT is provided by the ECU 5, the voltage of the in-vehicle battery 11 and stores it in-a capacitor 20.

The input energy control means 19 inputs the electrical energy stored in the capacitor 20 to the negative side (the ground side) of the primary coil 7.

The boosting circuit 18 is configured to include, in addition to the capacitor 20, a choke coil 21, a boosting switching means 22, a boosting driver circuit 23 and a second diode 24. In addition, the boosting switching means 22 is, for example, a MOS transistor.

The choke coil 21 has one end connected to the positive electrode of the in-vehicle battery 11. The energization state of the choke coil 21 is switched on/off by the boosting switching means 22. Moreover, the boosting driver circuit 23 provides a control signal to the boosting switching means 22, thereby turning on/off the boosting switching means 22. With the on/off operation of the boosting switching means 22, the magnetic energy stored in the choke coil 21 is charged as electrical energy into the capacitor 20.

In addition, the boosting driver circuit 23 is provided to repeatedly turn on/off the boosting switching means 22 in a predetermined cycle during the time period for which the ignition signal IGT is kept on by the ECU 5. Moreover, the second diode 24 is provided to prevent the electrical energy stored in the capacitor 20 from flowing back to the choke coil 21 side.

The input energy control means 19 is configured with an energy input switching means 27, an energy input driver circuit 28 and a third diode 29. In addition, the energy input switching means 27 is, for example, a MOS transistor.

The energy input switching means 27 is provided to switch on/off the input of the electrical energy stored in the capacitor 20 to the primary coil 7 from the negative side (the low-voltage side). The energy input driver circuit 28 provides a control signal to the energy input switching means 27, thereby turning on/off the energy input switching means 27.

Further, by turning on/off the energy input switching means 27, the energy input driver circuit 28 controls the electrical energy inputted from the capacitor 20 to the primary coil 7, thereby keeping the secondary electric current at a secondary electric current command value I2a for the time period for which the discharge continuation signal IGW is provided.

The discharge continuation signal IGW is a signal which commands an energy input timing and a time period for which the continuing spark discharge is to be continued. More specifically, the discharge continuation signal IGW commands a time period for which the energy input switching means 27 is to be repeatedly turned on/off, thereby inputting electrical energy from the boosting circuit 18 to the primary coil 7 (energy input time).

In addition, the third diode 29 is provided to prevent electric current from flowing from the primary coil 7 back to the capacitor 20.

A specific example of the energy input driver circuit 28 is a circuit which on/off controls the energy input switching means 27 by an open-loop control (feed-forward control), so as to keep the secondary electric current at the secondary electric current command value I2a.

Alternatively, the energy input driver circuit 28 may be a circuit which feedback controls the on/off state of the energy input switching means 27, so as to keep the detection value of the secondary electric current detected by the electric current detection resistor 16 at the secondary electric current command value I2a. In this case, a feedback circuit is provided such that: the circuit is connected with the detection line 17 and the detection value of the secondary electric current is inputted to the circuit; and the circuit produces and outputs a feedback value for controlling the energy input switching means 27 on the basis of the detection value of the secondary electric current and the secondary electric current command value I2a.

Moreover, the secondary electric current command value I2a is set in the ECU 5 and sent, as the secondary electric current command signal IGA, to the energy input driver circuit 28.

Features of First Embodiment

The ignition apparatus includes a blow-off determining unit 5*b*. The blow-off determining unit 5*b* determines, when the value ΔI2 of the time derivative of the secondary electric current exceeds a predetermined threshold value Z during a determination period, that blow-off has occurred; the determination period is a predetermined time period ΔT from the start of a spark discharge by the main ignition circuit 3. The blow-off determining unit 5*b* is provided in the ECU 5.

Moreover, based on the determination result from the blow-off determining unit 5*b*, the energy input commanding unit 5*a* generates and sends to the energy input circuit 4 both the discharge continuation signal IGW and the secondary electric current command signal IGA.

Specifically, when it is determined that blow-off has occurred during the main ignition, the energy input commanding unit 5*a* generates the discharge continuation signal IGW so as to perform the continuing spark discharge in the next cycle (during the next ignition); at the same time, the energy input commanding unit 5*a* sets an electric current value, which is obtained by adding a predetermined electric current value α to the detection value of the secondary electric current immediately before the occurrence of blow-off (hereinafter, to be referred to as the secondary electric current value I2x), as the secondary electric current command value I2a in the continuing spark discharge in the next cycle.

Figure 2:
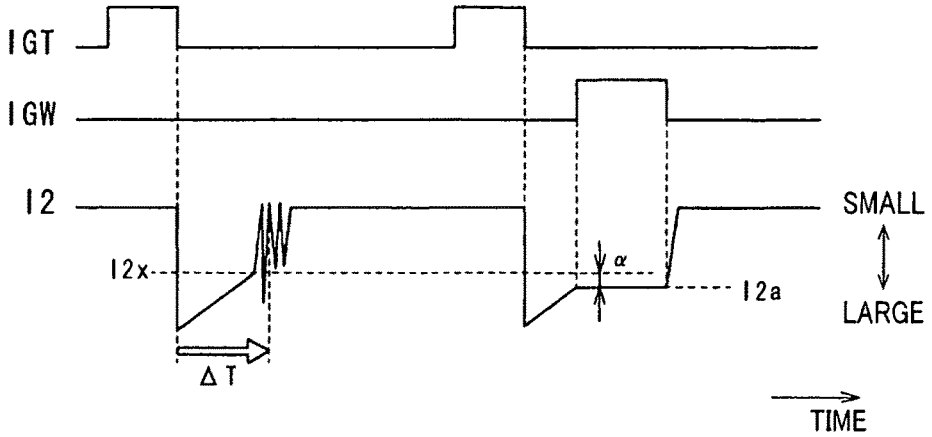
FIG. 2 shows time charts illustrating the operation of the ignition apparatus for an internal combustion engine (the first embodiment).
Figure 3:
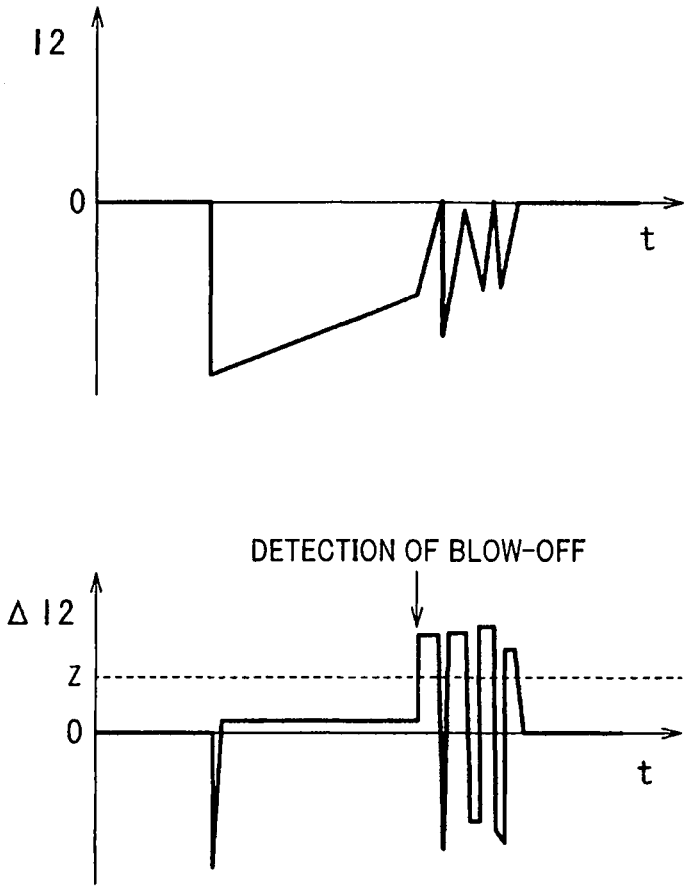
FIG. 3 shows time charts illustrating a blow-off determination (the first embodiment).

Referring to FIGS. 2-3, the operation and blow-off determination of the ignition apparatus will be described in more detail. In addition, in the time chart of the secondary electric current, the electric current value increases in the direction toward the negative side.

In the present embodiment, for example, in a predetermined operating condition, the discharge continuation signal IGW after the initial ignition signal IGT is low-outputted so as to perform only the main ignition without performing the continuing spark discharge.

To the blow-off determining unit 5*b*, there is inputted the detection value of the secondary electric current detected by the electric current detection resistor 16. As shown in FIG. 3, the blow-off determining unit 5*b* monitors the detection value of the secondary electric current and calculates the value ΔI2 of the time derivative of the secondary electric current based on the detection value.

Figure 7:
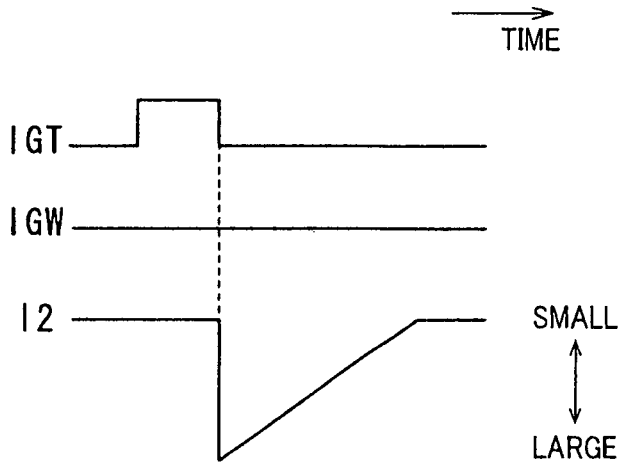
FIG. 7 shows time charts illustrating operation of the ignition apparatus for an internal combustion engine (the investigative example: not a publicly known art).
Figure 8:
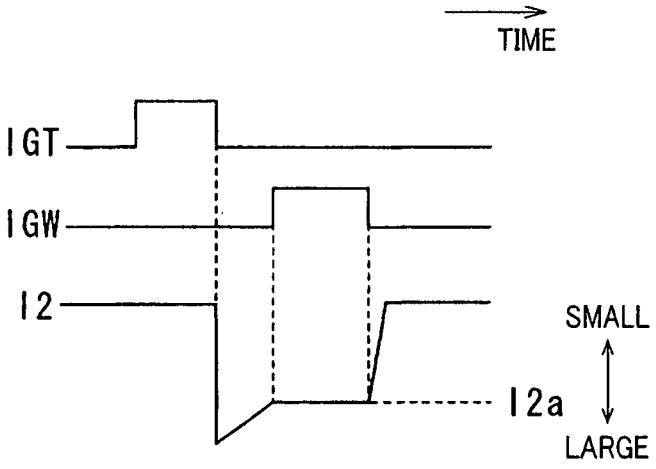
FIG. 8 shows time charts illustrating the operation of the ignition apparatus for an internal combustion engine (the investigative example: not a publicly known art).

If no blow-off has occurred during the attenuation of the secondary electric current in the main ignition, the secondary electric current attenuates substantially linearly as shown in FIG. 7. On the other hand, if blow-off has occurred during the attenuation of the secondary electric current in the main ignition, the secondary electric current rapidly increases/decreases during the attenuation. Therefore, it is possible to detect blow-off based on the value ΔI2 of the time derivative of the secondary electric current.

Specifically, when the value ΔI2 of the time derivative of the secondary electric current exceeds the predetermined threshold value Z during the predetermined time period ΔT (hereinafter, to be referred to as determination period ΔT) from the start of a spark discharge by the main ignition circuit 3 (i.e., from the falling of the ignition signal IGT), the blow-off determining unit 5*b* determines that blow-off has occurred.

Figure 4:
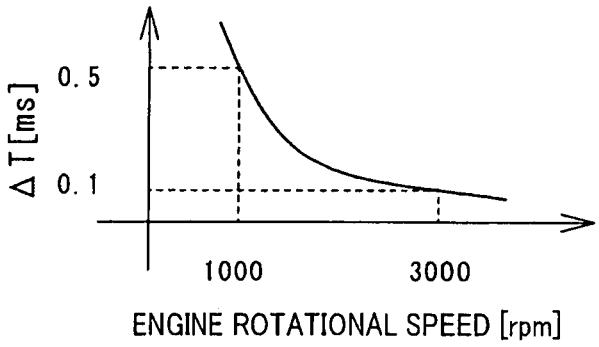
FIG. 4 is a correlation diagram illustrating the relationship between engine rotational speed and determination period (the first embodiment).

The determination period ΔT is set such that the higher the engine rotational speed, the shorter the determination period ΔT. For example, the determination period ΔT is set based on a map as shown in FIG. 4.

Further, when it is determined that blow-off has occurred during the main ignition, the energy input commanding unit 5*a* high-outputs the discharge continuation signal IGW after the ignition signal in the next cycle, thereby commanding the energy input circuit 4 to perform the continuing spark discharge.

Moreover, the energy input commanding unit 5*a* sets the electric current value that is obtained by adding the predetermined electric current value α to the secondary electric current value I2x immediately before the occurrence of blow-off as the secondary electric current command value I2a in the continuing spark discharge in the next cycle; then the energy input commanding unit 5*a* generates and sends to the energy input circuit 4 the secondary electric current command signal IGA. In addition, the electric current value α increases with the engine rotational speed.

Advantageous Effects of First Embodiment

The ignition apparatus of the first embodiment includes the blow-off determining unit 5*b*. The blow-off determining unit 5*b* determines, when the value ΔI2 of the time derivative of the secondary electric current exceeds the predetermined threshold value Z during the determination period, that blow-off has occurred; the determination period is a predetermined time period ΔT from the start of a spark discharge by the main ignition circuit 3.

Consequently, with the value ΔI2 of the time derivative of the secondary electric current, it is possible to accurately determine blow-off. Hence, it is also possible to take various measures to prevent misfire when it is determined that blow-off has occurred.

For example, in the present embodiment, when it is determined that blow-off has occurred during the main ignition (full-transistor ignition), it is controlled so as to perform the continuing spark discharge after the main ignition in the next cycle. Moreover, the secondary electric current command value in performing the continuing spark discharge is set to the electric current value that is obtained by adding the predetermined electric current value α to the secondary electric current value I2x immediately before the occurrence of blow-off.

Consequently, in the next cycle, it is possible to reliably prevent blow-off, thereby reliably preventing misfire.

Moreover, there are cases where blow-off occurs in a main ignition region due to differences between individual engines, variation among cylinders and age deterioration. In these cases, it is possible to detect the blow-off in the main ignition region and automatically employ the continuing spark discharge, thereby keeping each individual engine in an optimal state.

In addition, the main ignition region is a predetermined region of operating conditions which is set, according to the engine rotational speed, the engine load or the like, as a region where it is difficult for blow-off to occur when only the main ignition is performed and thus where only the main ignition is performed.

Moreover, the electric current value $\alpha$ is set such that the higher the engine rotational speed, the greater the electric current value $\alpha$.

When the engine rotational speed is low, the flow speed of gas flow around the ignition plug 1 is also low; therefore, even if the electric current value $\alpha$ is small, it is still possible to sufficiently prevent blow-off in the next cycle. In contrast, when the engine rotational speed is high, the flow speed of gas flow around the ignition plug 1 is also high; therefore, to reliably prevent blow-off, it is necessary to increase the electric current value $\alpha$.

Accordingly, by setting the electric current value $\alpha$ so as to increase with the engine rotational speed, it is possible to suppress unnecessary energy consumption in a low rotational speed region while reliably preventing blow-off in a high rotational speed region.

Modification of First Embodiment

In the first embodiment, the blow-off determining unit 5*b* determines only occurrence of blow-off. However, in addition to the determination of occurrence of blow-off, the blow-off determining unit 5*b* may further determine continuous occurrence of blow-off.

That is, when the number of times the value $\Delta I2$ of the time derivative of the secondary electric current exceeds the predetermined threshold value Z during the determination period $\Delta T$ is greater than or equal to a predetermined number, the blow-off determining unit 5*b* determines that blow-off has continuously occurred.

Moreover, in the first embodiment, when it is determined that blow-off has occurred during the main ignition (full-transistor ignition), it is controlled so as to perform the continuing spark discharge after the main ignition in the next cycle; the secondary electric current command value in performing the continuing spark discharge is set to the electric current value that is obtained by adding the predetermined electric current value $\alpha$ to the secondary electric current value I2x immediately before the occurrence of blow-off. However, it is also possible to control, when it is determined that blow-off has continuously occurred, it so as to perform the continuing spark discharge after the main ignition in the next cycle and set the secondary electric current command value in performing the continuing spark discharge to the electric current value that is obtained by adding the predetermined electric current value $\alpha$ to the secondary electric current value I2x immediately before the occurrence of blow-off.

For example, in cases where the value $\Delta I2$ of the time derivative of the secondary electric current is caused by noise to exceed the predetermined threshold value Z, it may be erroneously determined that blow-off has occurred though actually no blow-blow has occurred. In these cases, performing the continuing spark discharge in the next cycle and increasing the secondary electric current command value (increasing the input energy) would worsen electric power consumption.

However, by performing the continuing spark discharge in the next cycle and increasing the secondary electric current command value (increasing the input energy) only when it is determined that blow-off has continuously occurred, it is possible to prevent an unnecessary energy input due to an erroneous determination.

Second Embodiment

Figure 5:
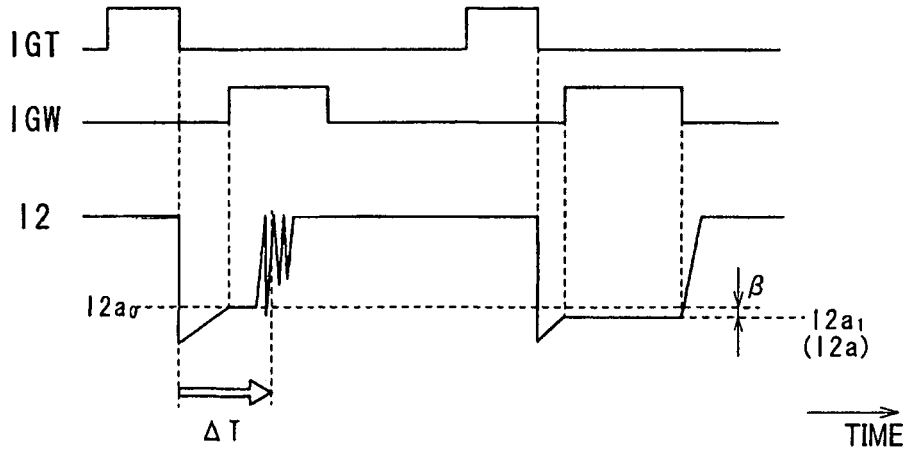
FIG. 5 shows time charts illustrating the operation of an ignition apparatus for an internal combustion engine (a second embodiment).
Figure 6:
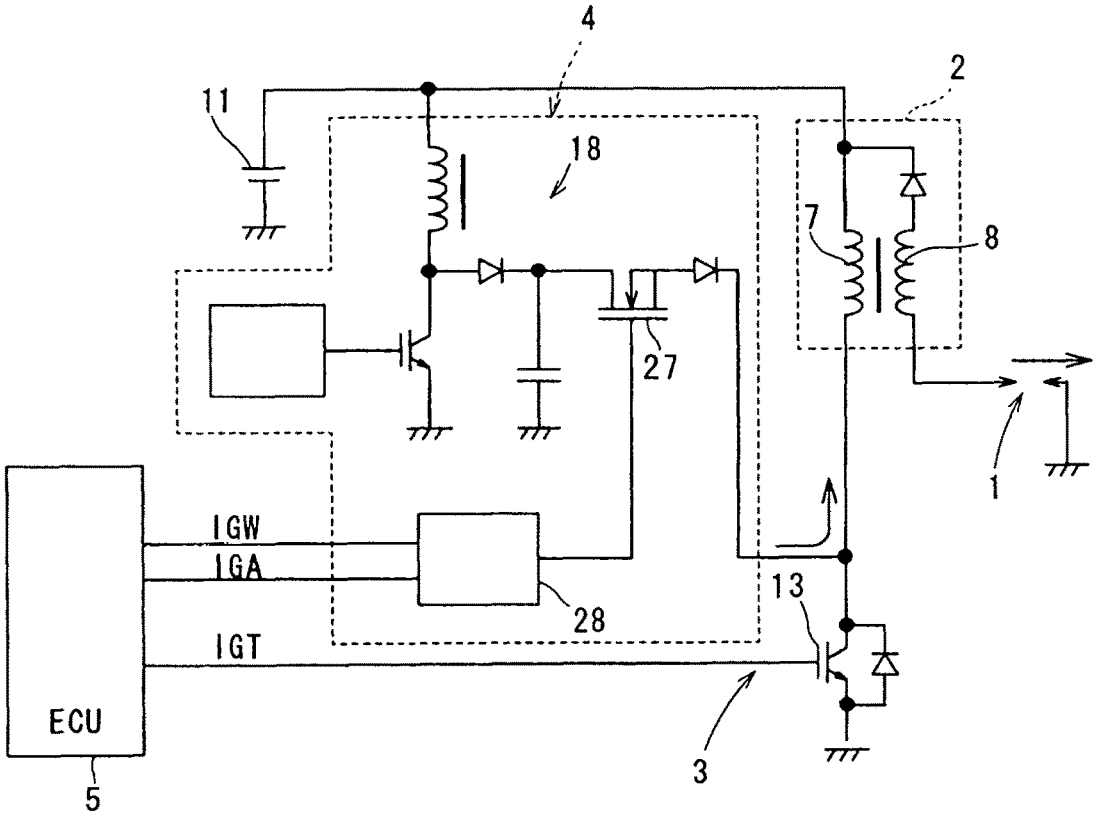
FIG. 6 is a schematic configuration diagram of an ignition apparatus for an internal combustion engine (an investigative example: not a publicly known art).

Referring to FIG. 5, the differences of a second embodiment from the first embodiment will be mainly described. In addition, in the second embodiment, reference signs the same as those in the first embodiment designate functional components identical to those in the first embodiment.

In an ignition apparatus of the present embodiment, when it is determined that blow-off has occurred during the continuing spark discharge, the energy input commanding unit 5*a* generates the discharge continuation signal IGW so as to perform the continuing spark discharge in the next cycle as well; at the same time, the energy input commanding unit 5*a* sets an electric current value, which is obtained by adding a predetermined electric current value $\beta$ to the secondary electric current command value I2a in the cycle where it is determined that blow-off has occurred, as the secondary electric current command value I2a in the continuing spark discharge in the next cycle.

That is, when it is determined that blow-off has occurred in a cycle where the continuing spark discharge has already been employed, it is controlled to perform the continuing spark discharge in the next cycle as well. Moreover, as shown in FIG. 5, let $I2a_1$ be the secondary electric current command value in the next cycle and $I2a_0$ be the secondary electric current command value in the current cycle (the cycle where it is determined that blow-off has occurred). Then, the secondary electric current command value $I2a_1$ is commanded as an electric current value that is obtained by adding the electric current value $\beta$ to the secondary electric current command value $I2a_0$.

Moreover, the electric current value $\beta$ is set such that the higher the engine rotational speed, the greater the electric current value $\beta$.

With the above configuration, it is possible to suppress variation of combustion during the shift from the main ignition region to the continuing spark discharge region or during the shift from the continuing spark discharge region to the main ignition region.

In the present embodiment, it is also possible to achieve the same advantageous effects as in the first embodiment.

In addition, the secondary electric current command value $I2a_1$ in the next cycle may be a preset value. That is, a large electric current value, to be employed as the secondary electric current command value when it is determined that blow-off has occurred, may be kept in advance as the preset value.

Modification of Second Embodiment

In the second embodiment, when it is determined that blow-off has occurred during the main ignition (full-transistor ignition), it is controlled so as to perform the continuing spark discharge after the main ignition in the next cycle; the secondary electric current command value $I2a_1$ in performing the continuing spark discharge is commanded as the electric current value that is obtained by adding the electric current value β to the secondary electric current command value $I2a_0$ in the current cycle. However, it is also possible to control, when it is determined that blow-off has continuously occurred, it so as to perform the continuing spark discharge after the main ignition in the next cycle and command the secondary electric current command value $I2a_1$ in performing the continuing spark discharge as the electric current value that is obtained by adding the electric current value β to the secondary electric current command value $I2a_0$ in the current cycle.

In addition, the method of determining continuous occurrence of blow-off is as described above in [Modification of First Embodiment].

INDUSTRIAL APPLICABILITY

In the above-described embodiments, examples are shown where the ignition apparatuses of the present invention are used in a gasoline engine. However, since the ignitability of fuel (more specifically, air-fuel mixture) can be improved by the continuing spark discharge, an ignition apparatus of the present invention may also be applied to engines that use ethanol fuel or blend fuel. As a matter of course, even if an ignition apparatus of the present invention is applied to an engine in which low-grade fuel may be used, it is still possible to improve the ignitability by the continuing spark discharge.

In the above-described embodiments, examples are shown where the ignition apparatuses of the present invention are used in an engine capable of lean burn operation. However, since it is possible to improve the ignitability by the continuing spark discharge in a combustion state different from lean burn, the application of an ignition apparatus of the present invention is not limited to a lean burn engine; instead, an ignition apparatus of the present invention may also be applied to an engine that does not perform lean burn.

In the above-described embodiments, examples are shown where the ignition apparatuses of the present invention are used in a direct injection engine that injects fuel directly into a combustion chamber. However, an ignition apparatus of the present invention may also be applied to a port injection engine that injects fuel to the intake upstream side of an intake valve (into an intake port).

In the above-described embodiments, examples are shown where the ignition apparatuses of the present invention are used in an engine that actively creates a rotational flow (tumble flow or swirl flow) of the air-fuel mixture in a cylinder. However, an ignition apparatus of the present invention may also be applied to an engine that does not have any rotational flow control means (tumble flow control valve or swirl flow control valve).

In the above-described embodiments, the present invention is applied to DI-type ignition apparatuses. However, the present invention may also be applied to a distributor-type ignition apparatus that distributes the secondary voltage to each ignition plug 1 or to an ignition apparatus of a single-cylinder engine (e.g., a motorcycle or the like) where it is unnecessary to distribute the secondary voltage.

DESCRIPTION OF REFERENCE SIGNS

1: ignition plug
2: ignition coil
3: main ignition circuit
4: energy input circuit
5: ECU
5*a*: energy input commanding unit
5*b*: blow-off determining unit
7: primary coil
8: secondary coil

The invention claimed is:

1. An ignition apparatus for an internal combustion engine, the ignition apparatus comprising:

a main ignition circuit that performs energization control of a primary coil of an ignition coil, thereby causing a spark discharge in an ignition plug;

an energy input circuit that inputs electrical energy to the primary coil during the spark discharge started by operation of the main ignition circuit, thereby applying a secondary electric current in the same direction to a secondary coil of the ignition coil, the energy input circuit also keeping the secondary electric current at a secondary electric current command value, thereby continuing the spark discharge started by operation of the main ignition circuit; and a blow-off determining unit which determines, when a value ΔI2 of the time derivative of the secondary electric current exceeds a predetermined threshold value Z during a determination period, that blow-off has occurred, the determination period being a predetermined time period ΔT from the start of the spark discharge by the main ignition circuit.

2. The ignition apparatus for an internal combustion engine as set forth in claim 1, wherein when the number of times the value ΔI2 of the time derivative of the secondary electric current exceeds the predetermined threshold value Z during the determination period is greater than or equal to a predetermined number, the blow-off determining unit determines that blow-off has continuously occurred.

3. The ignition apparatus for an internal combustion engine as set forth in claim 2, wherein the ignition apparatus further comprises an energy input commanding unit that generates, based on a determination result from the blow-off determining unit, a discharge continuation signal and a secondary electric current command signal and sends the generated signals to the energy input circuit, the discharge continuation signal being a command signal of spark discharge continuation, the secondary electric current command signal indicating the secondary electric current command value, referring to the spark discharge by the main ignition circuit as the main ignition and referring to the spark discharge continued by the energy input circuit as the continuing spark discharge, when it is determined that blow-off has continuously occurred during the main ignition, the energy input commanding unit generates the discharge continuation signal so as to perform the continuing spark discharge in a next cycle, and sets an electric current value that is obtained by adding a predetermined electric current value α to the secondary electric current value I2x immediately before the occurrence of blow-off as the secondary electric current command value in the continuing spark discharge in the next cycle.

4. The ignition apparatus for an internal combustion engine as set forth in claim 2, wherein the ignition apparatus further comprises an energy input commanding unit that generates, based on a determination result from the blow-off determining unit, a discharge continuation signal and a secondary electric current command signal and sends the generated signals to the energy input circuit, the discharge continuation signal being a command signal of spark discharge continuation, the secondary electric current command signal indicating the secondary electric current command value, referring to the spark discharge by the main ignition circuit as the main ignition and referring to the spark discharge continued by the energy input circuit as the continuing spark discharge, when it is determined that blow-off has continuously occurred during the continuing spark discharge, the energy input commanding unit generates the discharge continuation signal so as to perform the continuing spark discharge in a next cycle, and sets an electric current value, which is obtained by adding a predetermined electric current value β to the secondary electric current command value in the cycle where it is determined that blow-off has continuously occurred, as the secondary electric current command value in the continuing spark discharge in the next cycle.

5. The ignition apparatus for an internal combustion engine as set forth in claim 1, wherein the ignition apparatus further comprises an energy input commanding unit that generates, based on a determination result from the blow-off determining unit, a discharge continuation signal and a secondary electric current command signal and sends the generated signals to the energy input circuit, the discharge continuation signal being a command signal of spark discharge continuation, the secondary electric current command signal indicating the secondary electric current command value, referring to the spark discharge by the main ignition circuit as the main ignition and referring to the spark discharge continued by the energy input circuit as the continuing spark discharge, when it is determined that blow-off has occurred during the main ignition, the energy input commanding unit generates the discharge continuation signal so as to perform the continuing spark discharge in a next cycle, and sets an electric current value that is obtained by adding a predetermined electric current value α to the secondary electric current value I2x immediately before the occurrence of blow-off as the secondary electric current command value in the continuing spark discharge in the next cycle.

6. The ignition apparatus for an internal combustion engine as set forth in claim 5, wherein the energy input commanding unit sets the predetermined electric current value α such that the higher the engine rotational speed, the greater the predetermined electric current value α.

7. The ignition apparatus for an internal combustion engine as set forth in claim 1, wherein the ignition apparatus further comprises an energy input commanding unit that generates, based on a determination result from the blow-off determining unit, a discharge continuation signal and a secondary electric current command signal and sends the generated signals to the energy input circuit, the discharge continuation signal being a command signal of spark discharge continuation, the secondary electric current command signal indicating the secondary electric current command value, referring to the spark discharge by the main ignition circuit as the main ignition and referring to the spark discharge continued by the energy input circuit as the continuing spark discharge, when it is determined that blow-off has occurred during the continuing spark discharge, the energy input commanding unit generates the discharge continuation signal so as to perform the continuing spark discharge in a next cycle, and sets an electric current value, which is obtained by adding a predetermined electric current value β to the secondary electric current command value in the cycle where it is determined that blow-off has occurred, as the secondary electric current command value in the continuing spark discharge in the next cycle.

8. The ignition apparatus for an internal combustion engine as set forth in claim 7, wherein the energy input commanding unit sets the predetermined electric current value β such that the higher the engine rotational speed, the greater the predetermined electric current value β.

* * * * *